United States Patent [19]

Okuda et al.

[11] Patent Number: 4,734,747

[45] Date of Patent: Mar. 29, 1988

[54] COPYING MACHINE WITH A COPY PAPER DETECTION DEVICE

[75] Inventors: Masakiyo Okuda, Kashiwara; Kazuyuki Ohnishi, Nara; Shoichiro Yoshiura, Yamatokoriyama; Kimihito Yamasaki, Ikoma; Haruyoshi Ikeda, Yamatokoriyama, all of Japan

[73] Assignee: Sharp Kabushiki Kaisha, Osaka, Japan

[21] Appl. No.: 812,927

[22] Filed: Dec. 23, 1985

[30] Foreign Application Priority Data

Dec. 27, 1984 [JP] Japan ..... 59-276565
Dec. 27, 1984 [JP] Japan ..... 59-276577

[51] Int. Cl.[4] ..... G03G 15/00

[52] U.S. Cl. ..... 355/14 SH; 355/3 SH; 355/14 CU

[58] Field of Search ..... 355/14 R, 14 SH, 3 SH, 355/14 CU

[56] References Cited

U.S. PATENT DOCUMENTS 4,503,960 3/1985 Koeleman et al. ..... 355/14 SH
4,530,593 7/1985 Kasuya et al. ..... 355/14 SH
4,566,547 1/1986 Furukawa ..... 355/14 SH
4,576,472 3/1986 Ito et al. ..... 355/14 SH

FOREIGN PATENT DOCUMENTS 3432123 3/1985 Fed. Rep. of Germany ..... 355/14 CU

*Primary Examiner*—R. L. Moses
*Attorney, Agent, or Firm*—Birch, Stewart, Kolasch, & Birch

[57] ABSTRACT

In a copying machine in which a plurality of copies are made on a plurality of sheets of copy paper transferred from one or more paper cassettes, there are provided means for detecting the amount of the copy paper present in paper storing means, designating means for designating the number of paper to be copied, means for judging whether the amount of the copy paper present in said paper storing means exceeds the number of the copy paper designated by said designating means in a period after said paper storing means is set in the copying machine and before beginning of transferring of the copy paper to paper process means and means for alarming that the sheet number of the copy paper is more than the amount of the paper present in said paper storing means.

4 Claims, 11 Drawing Figures

COPYING MACHINE WITH A COPY PAPER DETECTION DEVICE

FIELD OF THE INVENTION

The present invention relates to a copying machine, and more particularly to a copying machine comprising paper feeding means for feeding copy paper.

BACKGROUND OF THE INVENTION

In general, a copying machine comprises paper feeding means (such as a paper feeding cassette or a paper feeding tray etc.) for accommodating copy paper and feeding the copy paper to a copy process. The paper feeding means is used to classify a plurality of copy paper sizes so as to make it easy to select the size of the copy paper used in the copy process. In addition, the copying machine comprises a continuous copy cycle which can copy a large number of originals by operating a copy number designation key.

However, in the copying machine comprising the paper feeding means and the continuous copying cycle, in case an operator designates a copy number of the original which is more than the number of copy paper sheets accommodated in the paper feeding means, then the copy paper set in the paper feeding means will become empty during the copy operation, and the copy operation must be stopped. A display device alerts the operator as to the absence of copy paper in said paper feeding means. At that time, an operator has to take out the paper feeding tray and set additional copy paper in the paper feeding tray. It, therefore takes a long time to add additional copy paper due to stoppage of the copy operation, thereby reducing the working efficiency of the copying machine.

Moreover, there is known a copying machine comprising reservation copy means and automatic original feeding means. In this copying machine, after an operator sets an original on an original platform of the automatic original feeding means and designates a copy condition such as a copy number, a copy density etc. in the copying machine, the original is fed to an exposure position automatically by the original feeding means and the copy operation is performed. Then, in case an operator designates a copy number of the paper which is more than the number of the copy paper sheets accommodated in the paper feeding means, it happens that the copy paper set in the paper feeding means becomes empty during the copy operation and the copy operation stops, similar to the above operation.

SUMMARY OF THE INVENTION

An essential object of the present invention is to provide a copying machine which is able to alarm an operator as to the shortage of copy paper in the copying machine before a copying operation is started, thereby reducing the down time on a copy operation due to a shortage of copy paper in a copying machine thereby increasing the working efficiency of the copying machine, and also for preventing machine stoppage in a reservation copy operation in a copying machine having the reservation copy function.

In order to achieve the object of the present invention there is provided a copying machine comprising copy process means for making a copy of an original on at least one sheet of copy paper, paper storing means for storing a plurality of sheets of copy paper, means for detachably receiving the paper storing means, means for feeding each copy paper from the paper storing means to the copy process means, means for detecting the amount of copy paper present in the paper storing means, designating means for designating the number of copies to be made, means for determining whether the amount of copy paper present in said paper storing means exceeds the number of copy papers designated by the designating means in a period after the paper storing means is set in the copying machine and before beginning the transfer of copy paper to the paper process means and means for alerting an operator that the number of sheets of copy paper request is more than the amount of the paper present in the paper storing means.

In the copying machine of the present invention, when an operator designates a copy sheet number which is more than the number of copy paper sheets set in the paper storing means such as a paper cassette or tray, an alarm occurs to tell an operator to supply the machine copy paper before beginning the copy operation.

DETAILED DESCRIPTION OF PREFERRED EMBODIMENT

Figure 1:
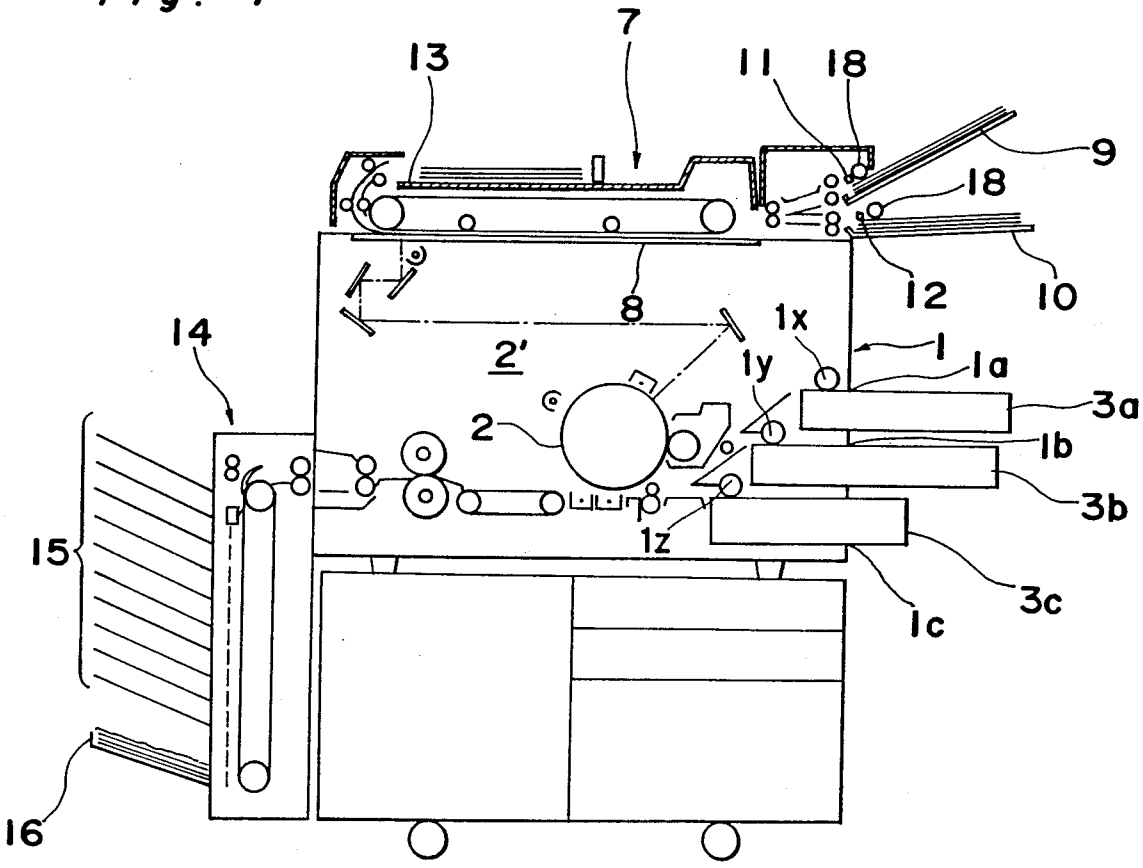
FIG. 1 is a schematic elevational view of a copying machine according to the present invention.

FIG. 1 is a schematic elevational view of an embodiment of a copying machine comprising a reservation copy function according to the present invention.

As shown in FIG. 1, 1 denotes a body of a copying machine comprising a copy process unit 2' including a photoreceptor drum 2 by which the image of an original to be copied can be transferred to a copy paper passing the photoreceptor drum 2 to make a copy in a known manner. Since the copy process is similar to that used in the conventional copying machine, details thereof are herein omitted. There are provided three paper cassette mounting ports 1*a*, 1*b* and 1*c* for detachably mounting paper feeding cassettes 3*a*, 3*b* and 3*c* at the right side of the body 1 of the copying machine. The paper feeding cassette 3*a* can accommodate 50 sheets of paper, the intermediate cassette 3*b* 250 sheets of paper, and the lower cassette 3*c* 500 sheets of paper, respectively. The various sizes of the copy paper can be set in each paper feeding cassette 3*a*, 3*b* and 3*c*. Each of the paper feeding cassettes 3*a*, 3*b* and 3*c* can be attached to the copying machine by inserting the paper feeding cassette into one of the predetermined paper mounting ports 1*a*, 1*b* and 1*c* in a known manner. There are provided paper feed rollers 1*x*, 1*y* and 1*z* corresponding to the cassette mounting ports 1*a*, 1*b* and 1*c* so as to contact with the top surface of the copy paper in the paper feeding cassette so that one copy paper can be delivered from the paper feeding cassette by rotation of the paper feed roller and the copy paper is fed to the photoreceptor drum 2 to make a copy in a known manner.

A normal operation panel 19 and a reservation function operation portion 31 are arranged on the upper surface of the body 1 of the copying machine.

An original platform for a normal copy operation is arranged on the upper surface of the body 1 of the copying machine, the platform being covered by an original cover (not shown). When a reservation copy function described later in detail is used, the original cover is removed and an automatic original feeding device (ADF) 7 is mounted on the original platform for a normal copy operation. The automatic original feeding device 7 is called "ADF" in the following. The ADF 7 includes two original platforms 9 and 10 for the reservation copy operation. The numeral 8 denotes a transfer belt for transferring an original set in the original platforms 9 and 10 for the reservation copy operation to an exposure position on the upper surface of the body 1 of the copying machine and transferring the original which has been copied to an original tray 13 at the upper portion of the ADF 7. In the following, "the normal copy operation" is called when a copy operation is performed without the ADF 7, while "the reservation copy operation" is called when a copy operation is performed with the ADF 7.

Numerals 11 and 12 denote original detecting sensors arranged on the original platforms 9 and 10 for the reservation copy operation. The original detecting sensors 11 and 12 comprise a light emitting element and a light detecting element, respectively. The light emitting element emits light to a reflection sheet (not shown) and the light detecting element can receive the reflected light when the original is not set on the original platforms 9 and 10. On the other hand, when the original is set on the original platforms 9 and 10, the light detecting element can not receive the reflected light. Thus, it is detected that the original for reservation copy operation is set on the original platforms 9 and 10. Numeral 18 denotes feeding rollers for feeding the original set on the original platforms 9 and 10.

Numeral 14 denotes a sorter which can sort and accommodate the copied paper, the sorter 14 comprises plural bins 15. A bin 16 provided only for use with the reservation copy operation is arranged at the lowest step of the sorter 14. The copied paper is transferred to the bin 16 in the reservation copying operation.

Figure 2:
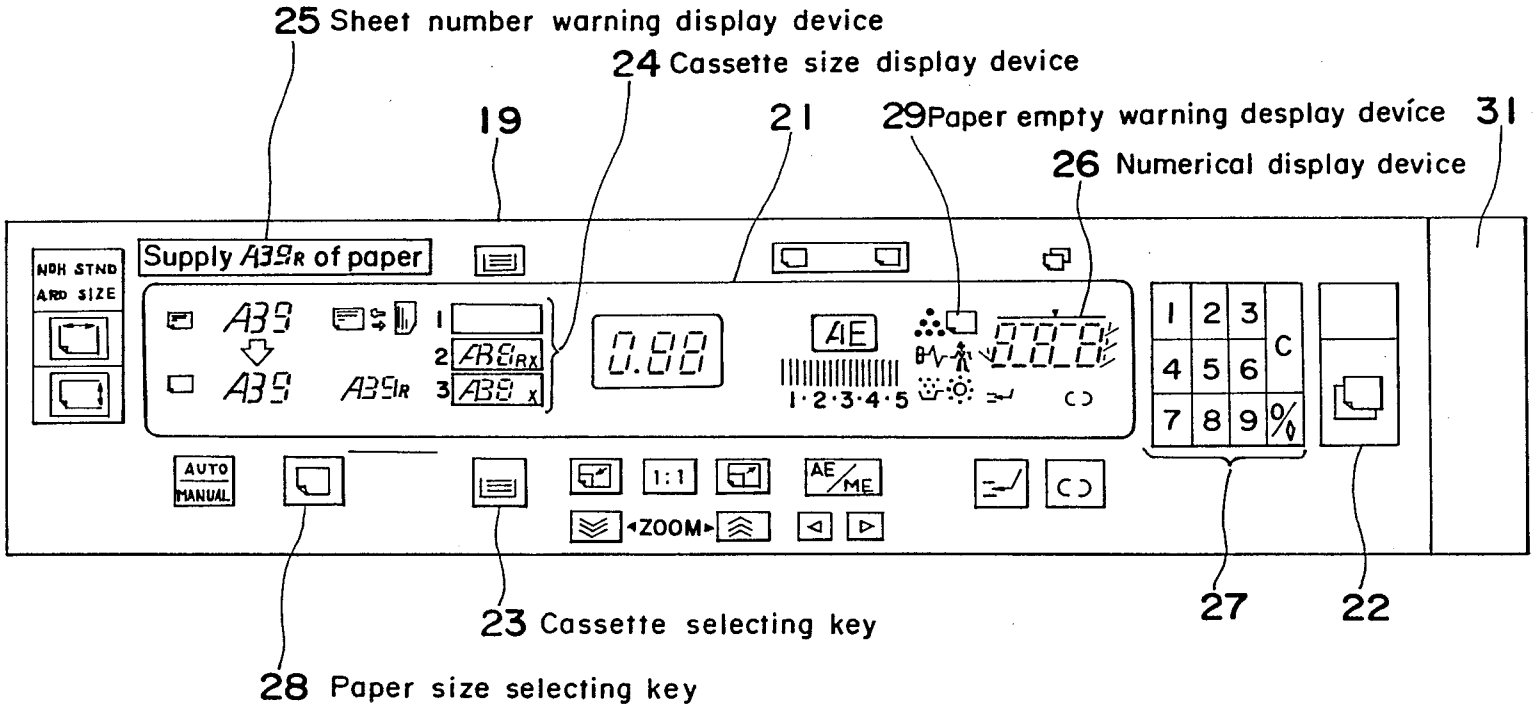
FIG. 2 is a schematic top plan view of an operation panel of the copying machine shown in FIG. 1.

FIG. 2 is a schematic top plan view of the normal operation panel 19 of the copying machine. A display portion 21 is arranged in the center of the normal operation panel 19. A copy switch 22 for starting a copy operation and ten keys 27 including 0–9 character keys are arranged at the left side of the display portion 21. A numerical display device 26 is arranged at the left side of the display portion 21, wherein a sheet number of the copy paper, which is inputted by the ten keys 27, is displayed. A display device 29 for indicating absence of the copy paper in the cassettes 3*a*, 3*b* and 3*c* is arranged at the left side of the numerical display device 26. The display device 29 is turned on when there occurs an empty paper condition in one of the cassettes 3*a*, 3*b* and 3*c*. A cassette size display device 24 is arranged at the central part of the display portion 21. By turning on a cassette selecting key 23 or a paper size selecting key 28 arranged at the lower part of the normal operation panel 19, the paper is fed from the paper feeding cassette selected. Each of the paper feeding cassettes 3*a*, 3*b* and 3*c* include an indicator for indicating the size of the paper accommodated in the paper feeding cassettes 3*a*, 3*b* and 3*c*, respectively. A detector arranged inside of the paper feeding portion of the body 1 of the copying machine detects the indication of the indicator and transmits the information of the indication to the cassettes size display device 24, then the sizes of the paper accommodated at the paper feeding cassettes 3*a*, 3*b* and 3*c* are displayed at the cassette size display device 24, respectively. A sheet number warning display device 25 is arranged at the upper part of the left side of the display portion 21.

Figure 3:
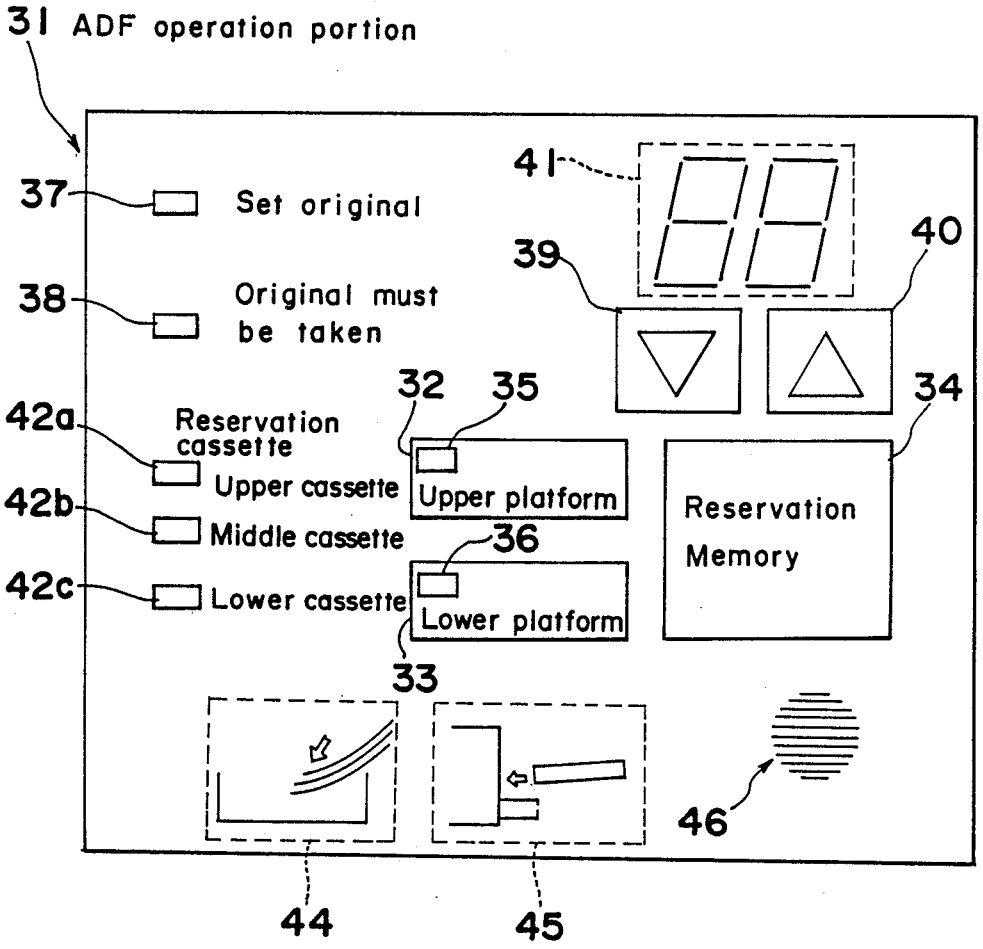
FIG. 3 is a schematic top plan view of an operation portion of an automatic original feeding device (ADF) operation portion of the copying machine shown in FIG. 1.

FIG. 3 is a schematic top plan view of the ADF operation portion 31. An upper platform reservation key 32, a lower platform reservation key 33 and a reservation memory key 34 are arranged at the ADF operation portion 31. The upper platform reservation key 32 and the lower platform reservation key 33 are used for designating the original platforms 9 and 10 for the reservation copy operation, reservation display devices 35 and 36 are arranged by the upper platform reservation key 32 and the lower platform reservation key 33, respectively. A display device 37 is provided for displaying that an original must be set on the original platforms 9 and 10. A display device 38 displays that an original must be taken out. A down key 39 and an up key 40 are provided for inputting the sheet numbers of the original for the reservation copy operation. An original sheet number display device 41 is adapted display the sheet number of the original for the reservation copy operation. One of the paper feeding cassettes can be selected upon the reservation copy operation by turning on the cassette size selecting key 23 or the paper size selecting key 28 arranged at the normal operation panel 19, as well as described above. Reserved cassette display devices 42*a*, 42*b* and 42*c* are arranged at the ADF operation portion 31. A paper supply display device 44 is provided for designating the shortage of the paper accommodated at the paper feeding cassettes 3*a*, 3*b* and 3*c*. A cassette set display device 45 is provided for indicating that the paper feeding cassette designated for the reservation copy operation is not set. Each of the display devices 44 and 45 are turned on when the above condition takes place in order to warn that condition to an operator. A speaker 46 is provided for making an alarm sound (a warning sound) when the paper feeding cassette designated for the reservation copy operation is not set or the feeding paper is short, and an alarm sound generation circuit is arranged in the ADF operation portion 31 (not shown).

Figure 4:
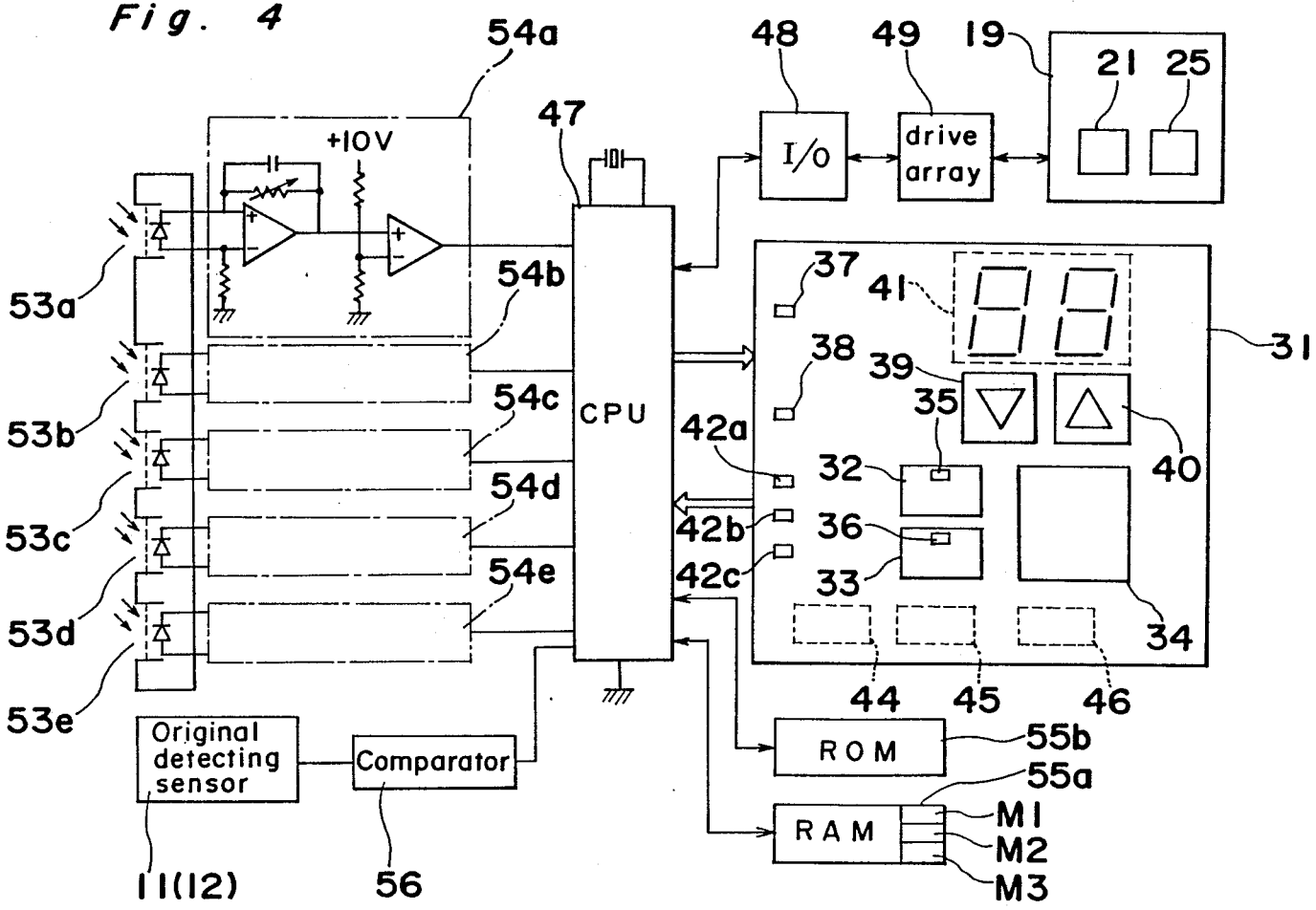
FIG. 4 is a circuit diagram of a control device of the copying machine shown in FIG. 1.

FIG. 4 is a block diagram of a control circuit arrangement of the copying machine.

CPU 47 is connected to a RAM 55*a* and a ROM 55*b* via an internal bus. An operating program for the CPU 47 is stored in the ROM 55*b*. The sheet numbers of the paper accommodated in the paper feeding cassettes 3*a*, 3*b* and 3*c* are stored at the memory areas M1, M2 and M3 of RAM 55*a*. The CPU 47 is connected to a drive array 49 driving the normal operation panel 19 via an I/O interface circuit 48, wherein the information of the key operation operated by an operator is inputted to the CPU 47 and the information from the CPU 47 is displayed at the display portion 21 and the sheet number warning display device 25.

Detecting outputs of the original detecting sensors 11 and 12 are compared with reference voltages by a comparator 56, respectively. If the detecting outputs of the sensors 11 and 12 are less than the reference voltages, the comparator 56 outputs an original non-set signal to the CPU 47. The CPU 47 judges whether or not the original is set on the original platforms 9 and 10 in accordance with the output of the comparator 56.

Figure 5:
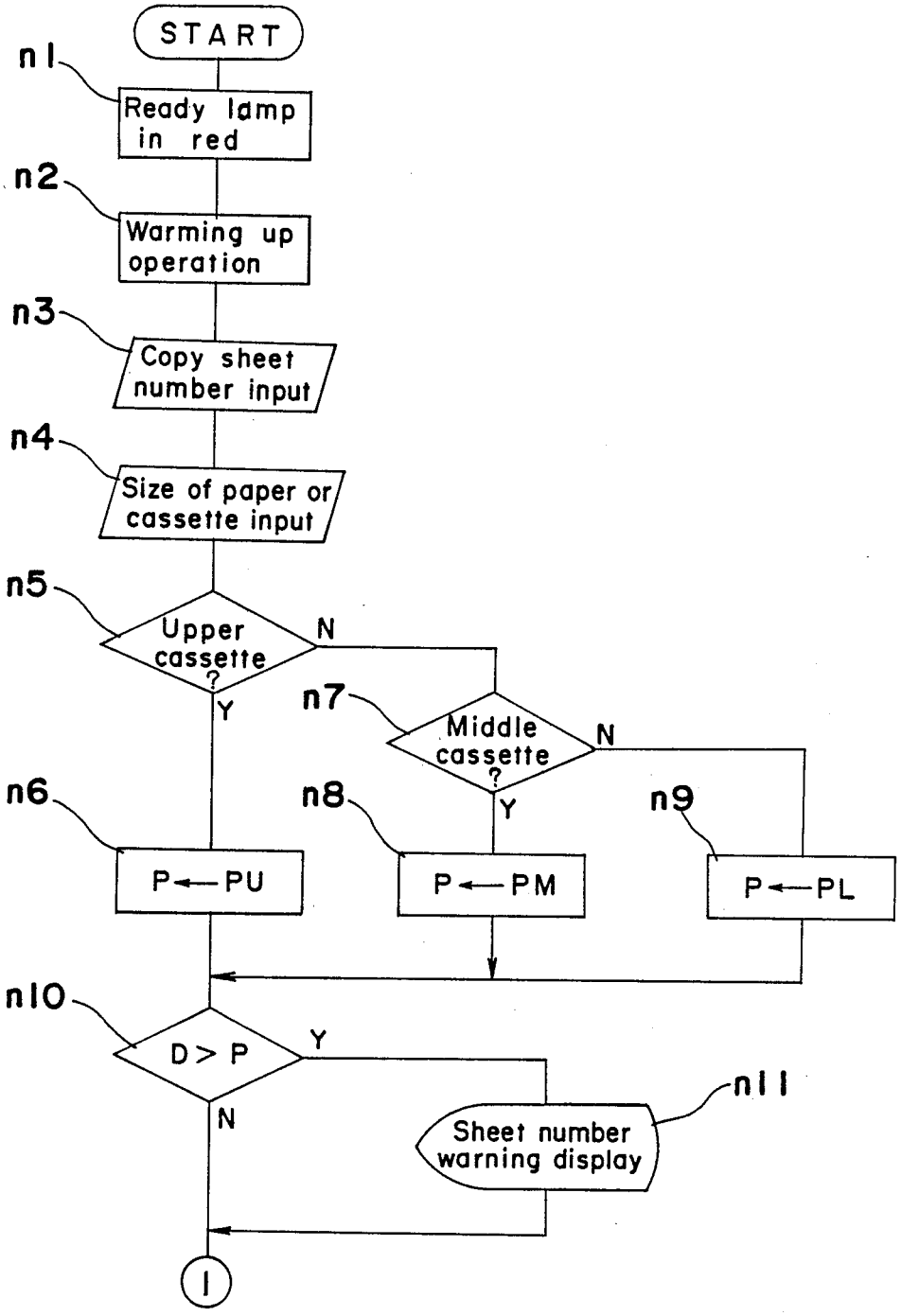
FIGS. 5(A), 5(B) and 5(C) are flow charts showing a copy operation of the copying machine shown in FIG. 1.
Figure 5B:
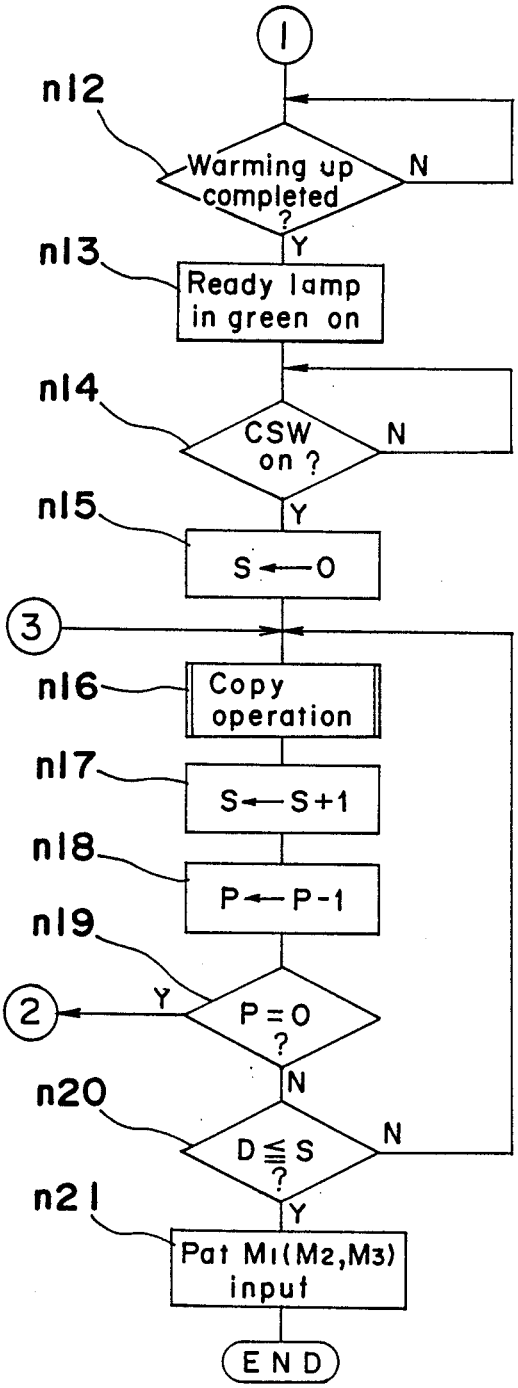
Figure 5C:
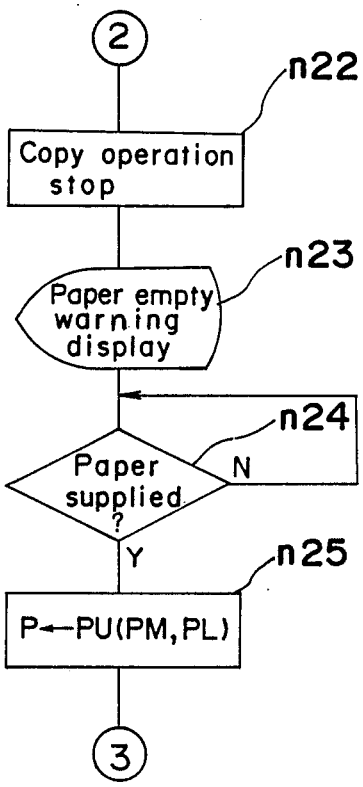

FIGS. 5(A), 5(B) and 5(C) are flow charts showing the operation of the copying machine.

When a power switch (not shown) is turned on, a ready lamp is turned on in red at the step n 1, and a warming up operation proceeds in order to increase the temperature of a fixing roller the the step n 2. The sheet number D of the paper to be copied is inputted by operating the ten keys at step n 3. Then at step n 4, the size of the paper is inputted by operating the paper size selecting key 28, or the information of the paper feeding cassette to be used is inputted by operating the cassette selecting key 23. After that, it is judged which of the cassettes 3*a*, 3*b* and 3*c* is selected is set at steps n 5 and n 7. First of all, at step n 5, it is judged if the size of the paper accommodated in the upper feeding paper cassette 3*a* is the size of the paper selected, if not, the program flow goes to step n 7. At step n 7, it is judged if the size of the paper accommodated in the middle feeding paper cassette 3*b* is the size of the paper selected, if not, the program flow goes to step n 9. At step n 5, if the size of the paper accommodated in the upper feeding paper cassette 3*a* is the size of the paper selected, the sheet number PU accomodated in the cassette 3*a* and stored in the memory area M1 of the RAM 55*a* is transferred to a sheet number counter P, the sheet number PU is stored at the sheet number counter P. If the size of the paper accommodated in the middle feeding paper cassette 3*b* is the size of the paper selected at step n 7, the sheet number PM accommodated in the cassette 3*b* and stored in the memory area M2 of the RAM 55*a* is stored at the sheet number counter P at step n 8. If the size of the paper accommodated in the middle feeding paper cassette 3*b* is not the size of the paper selected, it is judged that the lower paper feeding cassette is selected, and the sheet number PL accommodated in the cassette 3*c* stored at the memory area M3 of the RAM 55*a* is stored at the sheet number counter P at step n 9.

After that, the program flow goes to step n 10, wherein the copy sheet number D inputted at step n 3 is compared with the value P of the sheet number counter inputted at any one of steps n 6, n 8, and n 9. Step n 10 corresponds to the sheet number comparing means of the present invention. At step 10, if the copy sheet number D is more than the value P of the sheet number counter, the program flow goes to step n 11, and the sheet number warning display device 25 arranged at the normal operation panel 19 is turned on in order to tell an operator to set the paper in the copy paper feeding cassettes 3*a*, 3*b* and 3*c*. Step n 11 corresponds to the display means for displaying the sheet number warning of the present invention. The sheet number warning display device 25 displays the size of the paper to be set. At step n10, if it is judged that the copy sheet number D is equal to or less than the value P of the sheet number counter, the program flow goes to step n 12.

As shown in FIG. 5(B), it is judged if the warming up operation is completed or not at step n 12. In case the warming up operation is completed, the ready lamp is turned on in green at step n 13 in order to tell an operator that it is possible to proceed with the copy operation. If the copy switch 22 is turned on by an operator at step n 14, "0" is stored in the counter S for counting the number of the copy process times at step n 15, and the copy operation begins at step n 16. After the copy operation begins at step n 16, "1" is added to the content of the counter S at step 17, "1" is subtracted from the content from the content of the counter P and the subtracted value is stored at the counter P. It is judged if the content of the sheet number counter P is "0" or not at the step n 19. At step n 19, if the content of the sheet number counter P is not "0", the program flow goes to step n 20, the copy sheet number D inputted is compared with the content of the counter S at step n 20. On the other hand, if the content of the counter S is less than the copying sheet number D at step n 20, the program flow goes back to step n 16. By cycling the respective steps n 16→n 17→n 18→n 19→n 20→n 16, the copy operation is performed the number of times of the copy sheet number D inputted. At step n 19, if the content of the sheet number counter P is "0", the program flow goes to step n 22, as shown in FIG. 5(C), the copy operation stops, and the empty paper warning display device 29 of the normal operation panel 19 is turned on at step n 23 in order to tell an operator that the copy paper should be supplied. At step n 24, if the supplement of the copy paper is completed, the program flow goes to step n 25, then the selected one among maximum sheet number PU, PM, or PL accommodated in the paper feeding cassettes 3*a*, 3*b* and 3*c* is stored in the sheet number counter P, and the program flow goes back to step n 16.

On the other hand, if the copy sheet number D is equal to or less than the content of the counter S, when the copy operation of the inputted copy sheet number D of the paper is completed, the value of the sheet number counter P is stored at the selected ones of the memory areas M1, M2 and M3 at the step n 21. Then program flow goes to the end, the program operation is completed.

As described above, by counting the sheet number accommodated in the cassettes 3*a*, 3*b* and 3*c* with the sheet number counter P and comparing the sheet number accommodated in the cassette with the copy sheet number inputted, it is possible to judge if a sufficient amount of copy paper is in the paper feeding cassette.

Figure 6:
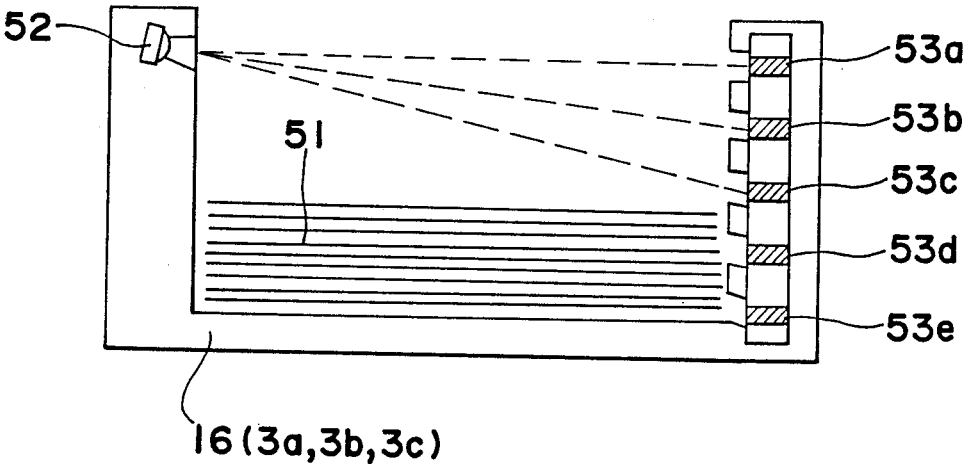
FIG. 6 is a schematic elevational view of a detecting means for detecting a remaining quantity of copy paper, or a maximum paper quantity to be transferred to a bin, which is arranged at a paper feeding cassette or a paper feeding tray of the copying machine shown in FIG. 1.

FIG. 6 is a schematic elevational view of the detecting means for detecting the remaining quantity of copy paper accommodated in the cassettes 3*a*, 3*b* and 3*c* or the maximum paper quantity to be transferred to the bin 16. The detecting means comprise a light emitting element 52 and five light detecting elements 53*a*, 53*b*, 53*c*, 53*d* and 53*e* arranged inside of the cassettes 3*a*, 3*b*, 3*c*, or bin 16. The light detecting elements 53*a*–53*e* are arranged in the direction of piling up of the paper. The light detecting elements 53*a*–53*e* arranged below the level of the piling paper cannot receive the light of the light emitting element since the light is interrupted by the piling paper 51. Therefore, by counting the number of the light detecting elements which cannot receive the light, it is possible to detect the remaining quantity of the copy paper 51 in the paper feeding cassettes 3*a*, 3*b* and 3*c*. On the other hand, in case of the bin 16, by counting the number of the light detecting elements which can receive the light, it is possible to detect the maximum sheet number to be transferred to the bin 16.

Referring back to FIG. 4, 54*a*, 54*b*, 54*c*, 54*d* and 54*e* denote circuits, which detect the outputs of the corresponding light detecting elements 53*a*, 53*b*, 53*c*, 53*d* and 53*e*, respectively, compare the output levels with the reference levels, and determine if the light is detected or not. Then each of the circuits 54*a*–54*e* output the result of the above determination to the CPU 47. In case the paper feeding cassette is not set, the circuits 54*a*–54*e* may not output the result, therefore, it is possible to detect that the paper feeding cassettes 3*a*, 3*b* and 3*c* are not set.

In the present embodiment, the copy sheet number of the paper which can be used in the reservation copy operation is counted by detecting the maximum sheet number to be transferred to the bin 16. On the other hand, the copy sheet number of the paper which can be used in the reservation copy operation can be counted by detecting the remaining sheet numbers in the paper feeding cassettes 3*a*, 3*b* and 3*c*.

The reservation procedure will be described below. First of all, the reservation key 32 or 33 of the original platform, where the original is not set, is turned on, then the display device 37 is flashed in order to tell an operator that the original should be set, and also any one of the reservation display device 35 or 36 corresponding to the operated reservation key is flashed. Subsequently, the original for the reservation copy operation is set on the original platform 9 or 10, then the display device 37 is turned off. The copy condition, such as the sheet number of the original, the copy number of the original, the size of the paper, the paper feeding cassette, and the copy density etc., are inputted by operating the keys arranged in the normal operation panel 19, and the reservation memory key 34 is turned on. At that time, one of the reservation cassette display devices 42*a*, 42*b* or 42*c* is turned on. By turning on the reservation memory key 32 or 33, the reservation condition inputted is stored and the reservation arrangement is completed, then the reservation display device 35 or 36 change from turning a flashing condition to an on condition. At the reservation arrangement, if the maximum sheet number to be transferred to the bin 16 or copy number of the original counted by the inputted sheet number of the original is less than the copy number inputted, the said copy number of the original counted by the inputted sheet number of the original is stored as a threshold copy number which can be copied in the reservation copy operation. Before the reservation copy operation, it is checked whether or not the designated paper feeding cassettes 3*a*, 3*b* and 3*c* are set and whether or not the sheet of the paper which is more than the sheet number of the reservation copy operation is set in the designated paper feeding cassette. Then, if the designated paper feeding cassette is not set, or if the sheet of the paper which is more than the sheet number of the reservation copy operation is not set, the alarm sound is made and also the display device 44 for designating the shortage of paper or the display device 45 for designating that the paper feeding cassette is not set in the paper feeding cassette is turned on. Furthermore, if the original remains on the original platforms 9 and 10 after the above reservation copy operation, the display device 38 is flashed in order to tell an operator that the original should be taken out.

Figure 7:
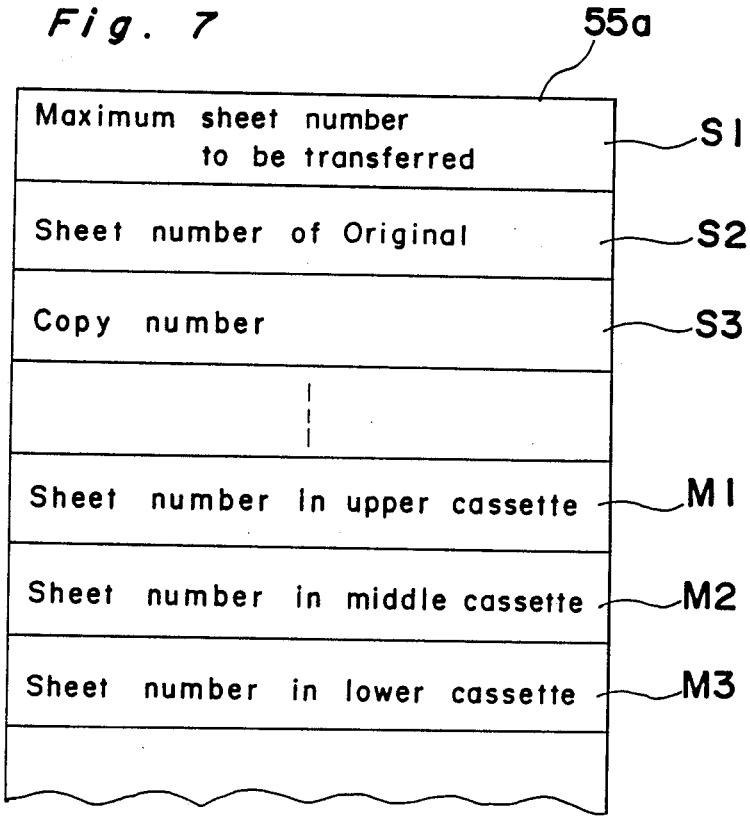
FIG. 7 is a memory map of a RAM used in the control device of the copying machine shown in FIG. 1.

FIG. 7 is a main construction diagram of the RAM 55*a*. The maximum sheet number to be transferred to the bin 16 is stored at a memory area S1, the inputted sheet number of the original is stored at a memory area S2, and the copy number inputted is stored at a memory area S3. The sheet numbers of the upper paper feeding cassette 3*a*, the middle paper feeding cassette 3*b*, and the lower paper feeding cassette 3*c* are stored at the memory areas M1, M2 and M3, respectively.

Figure 8A:
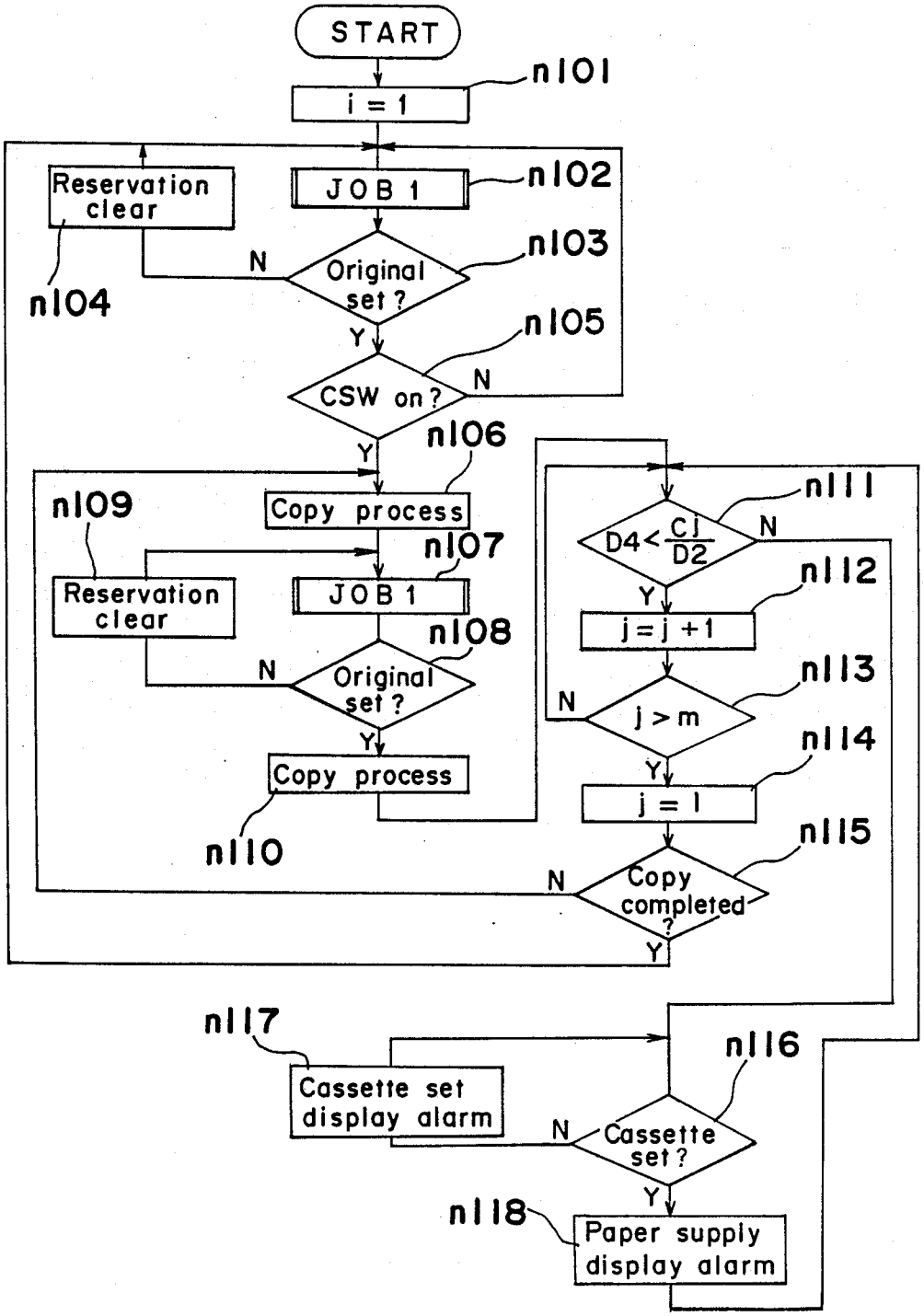
FIGS. 8(A) and 8(B) are flow charts showing an operation of the reservation arrangement process of the copying machine shown in FIG. 1.
Figure 8:
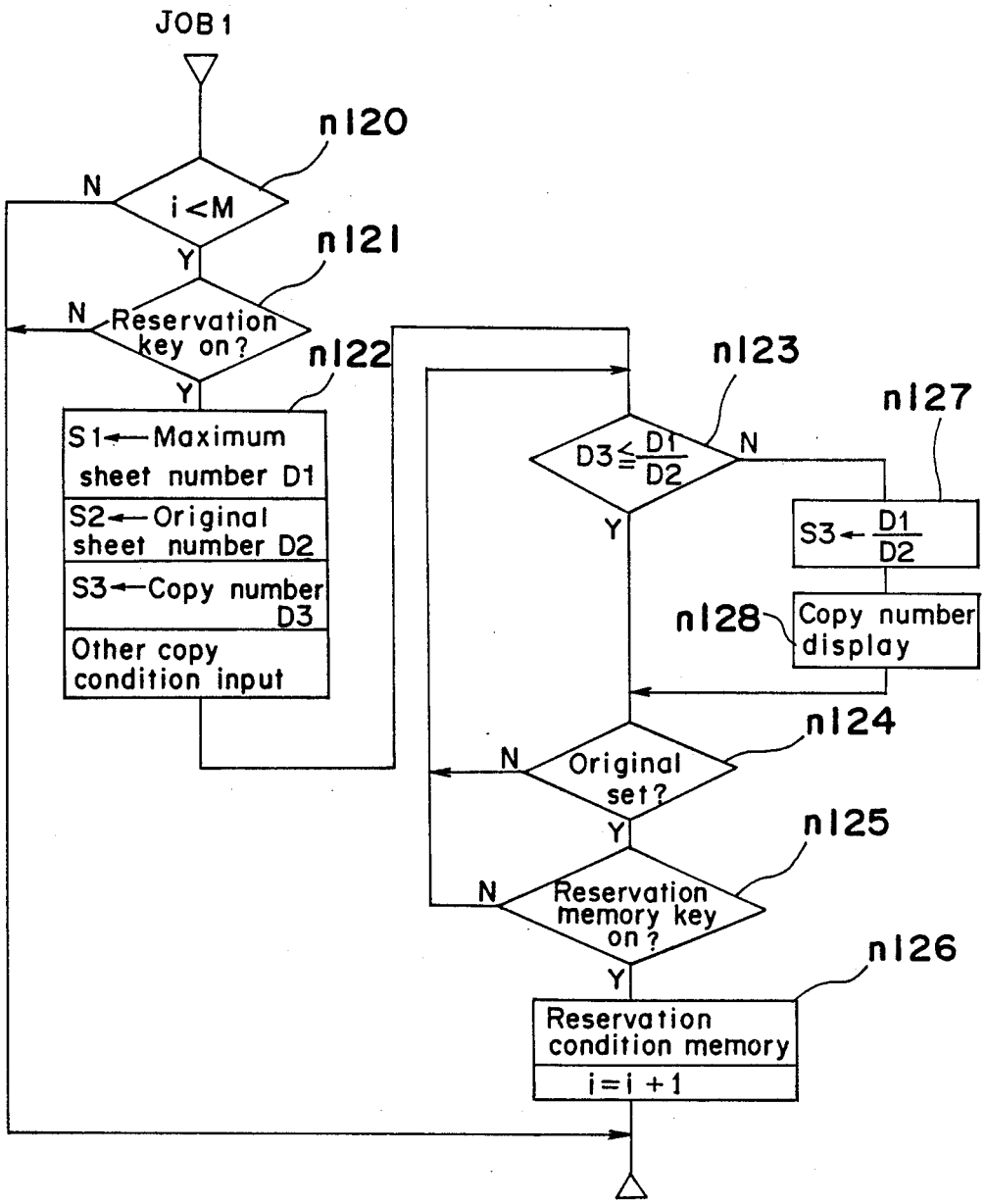

FIGS. 8(A) and 8(B) are flow charts showing the operation of the reservation arrangement. Referring to FIGS. 8(A) and 8(B), the operation of the reservation arrangement will be described.

First of all, it is assumed that the original is set on the upper original platform 9. A "1" is set at the set number i of the original platform at the step n 101. The operation of the reservation arrangement, or the waiting condition until the normal copy operation with the ADF starts, is performed at the step n 102 through n 104. On the other hand, the operation of the reservation arrangement after the normal ADF copy operation starts by turning on the copy switch 22 is performed at the steps n 107 through n 109 which are interruption process steps. Steps n 120 through n 128 shown in FIG. 8(B) correspond to the reservation arrangement routing JOB1 at steps n 102 and n 107.

In the reservation arrangement or the waiting condition until the normal copy operation with ADF starts, it is first determined at step n 120, if the set number i is less than the number M (=2) of the original platforms. In this case, as $i=1$ ($<2$), the reservation copy operation is accepted. The reservation key 32 or 33 is turned on at step n 121 and the copy condition is inputted at step n 122. Then, the sheet number D2 and D3 of the original for the reservation copy operation are stored at the memory areas S2 and S3, respectively. The sheet number of the original is displayed in digital value at the original sheet number display device 41. The copy number is displayed in digital value at the copy number display device 26. The maximum sheet number D1 to be transferred to the bin 16, which is detected by the aforementioned detecting means for detecting the maximum sheet quantity, is stored at the memory area S1. After the copy condition is inputted, at step n 123, the sheet number D2 of the original is divided by the maximum sheet number D1 to be transferred, then the value D1/D2 corresponds to the threshold value of the copy sheet number which can be reserved. Moreover, the threshold value calculated is compared with the counted copy number. If the copy number D3 inputted is equal to or less than the threshold value, it is determined whether or not the original for the reservation copy operation is set on the original platform 9 or 10 at the step n 124. Then if the original detecting sensor 11 or 12 detects that the original is set, the completion operation of the reservation arrangement by operating the reservation memory key 34 is accepted. On the other hand, if the original detecting sensor 11 or 12 detects that the original is not set on the original platform 9 or 10, the completion operation of the reservation arrangement by operating the reservation memory key 34 is not accepted. Thus, in case an operator forgets that the original for the reservation copy operation should be set, the above operation prevents the copying machine from performing the reservation copy operation with no original. When the original is set and the reservation memory key 34 is turned on, the above copy condition is stored and "1" is added to the set number i at steps n 125 and n 126.

On the other hand, if the inputted copy number is more than the threshold value, the threshold value D1/D2 is stored at the memory area S3 at step n 127. After that, the displaying value of the copy number display device 41 of the inputted value D3 is changed to the threshold value at step n 128. Thus, the copy number on the reservation copy operation is limited to the threshold value, so the above operation prevents interruption of the reservation copy operation. After displaying the copy number, the program flow goes to step n 124, and it is determined whether or not the original for the reservation copy operation is set on the original platform 9 and 10. If the original is set at step n.124, the program flow goes to step n 125, then it is judged if or not reservation memory key 34 is turned on at the step n 125 as described above.

After the reservation arrangement is completed by the routine JOB1, it is determined again whether the original is set on the original platform 9 or 10 at step n 103. When the original detecting sensor 11 or 12 detects that the original is not set on the original platform 9 or 10 and it is determined that the original has already been taken out after the reservation arrangement, the above reservation is canceled and the reservation condition is cleared at step n 104. Thus, the above operation prevents the reservation copying operation if there is no original. If the original is set properly without taking out the original, the reservation arrangement is completed. After the reservation arrangement, the copy switch 22 is turned on at step n 105, and the ADF copy operation proceeds, wherein the original set on the original platform 9 or 10 is copied.

When the reservation arrangement is performed on the ADF copy operation, the operation of the reservation arrangement is performed by the routine JO1 (at steps n 107 through n 109) in the copy process of steps n 106, n 110 and n 111). In this case, the reservation arrangement is not completed on the condition that the original is not set. Moreover, when it is detected that the original for the reservation copy operation has already been taken out after the reservation arrangement at step n 108, the reservation is canceled and the reservation condition is cleared at step n 109.

After the reservation arrangement, it is detected if the reserved paper feeding cassette is set or not, and the rest of the copy paper set in the paper feeding cassettes 3 a, 3*b*, and 3*c* is detected at step n 111. The inputted copy number which is stored at the memory area S3 or the value D1/D2 set at step n 127 is set as D4. The sheet numbers of the copy paper set in the paper feeding cassettes 3*a*, 3*b* and 3*c* are set as Cj (j=1, 2, 3), respectively. At step n 111, the sheet number Cj of the paper set in the paper feeding cassette, which is counted by the detecting means for detecting the paper quantity, is divided by the sheet number D2 of original, then the value Cj/D2 is compared with D4. At this step, the comparing check is performed concerning the number m of the paper feeding cassettes 3*a*, 3*b* and 3*c* set in the body 1 of the copying machine machine at steps n 112 and n 113. In the present embodiment, there are three paper feeding cassettes 3*a*, 3*b* and 3*c*, that is, m=3. If D4<Cj/D2, it is determined that the sheets of pape, which is more than the sheet number of paper for the reservation copy operation, are set in the paper feeding cassettes 3*a*, 3*b* and 3*c*, then "1" is set at the number j of the checking times at step n 114, and if the copy operation is completed at step n 115, the program flow goes to step n 102. On the other hand, if D4≧Cj/D2, it is determined whether this condition is the case in which the designated paper feeding cassette is not set or the case of the shortage of paper at step n 116. If the paper feeding cassette is not set, the alarm sound is made and also the display device 45 for designating that the paper feeding cassette should be set is turned on at step n 117 and the program flow goes back to step n 116. On the other hand, in case of the shortage of paper, the alarm sound is made and also the display device 44 for designating that the paper should be supplied in the paper feeding cassette is turned on at step n 118 and the program flow goes back to step n 111. As described above, by making the alarm sound and turning on the display device 44 or 45, an operator can certainly know the condition that that paper feeding cassette is not set, or the copy paper is short before begining the reservation copy operation. Therefore, by making an operator set the paper feeding cassette or supply the copy paper before the reservation copy operation, the above operation prevents the default or interruption caused by not setting the paper feeding cassette or the shortage of paper, and also it is possible to perform the reservation copy operation. Moreover, when the display device 44 for designating that the copy paper should be supplied is turned on, it is not possible to continue the copy operation except the reservation copying without supplying the copy paper, so the copy paper for the reservation copy operation can be supplied when the copy operation is completed. The above comparing check is performed on the ADF copy operation except that the reservation copy operation is performed at step n 115 every time the copy process is completed, so it can be warned that the paper feeding cassette is not set or the the paper is short before beginning the reservation copy operation.

The above steps n 111 through n 113 and n 116 correspond to the comparing means, and steps n 117 and n 118 correspond to the display means.

Moreover, at the above operation that the copy number is arranged, the remaining number of paper sheets set in the designated paper feeding cassette 3*a*, 3*b* or 3*c* and the maximum accommodating sheet number of the designated paper feeding casssette 3*a*, 3*b* or 3*c* as well as the maximum sheet number to be transferred to the bin 16 are detected. The copy number of which the paper can be copied for a reservation copy operation can be calculated by using the minimum value of the above three values.

What is claimed is:

1. A copying machine comprising:

copy process means for making at least one copy of an original put on an original platform on at least one copy paper sheet;

original transferring means attached to the copying machine for automatically transferring at least one original to be copied to the original platform;

means for reserving the number of copy paper sheets corresponding to the number of originals to be copied;

paper storing means for storing a number of copy paper sheets;

means for detachably receiving said paper storing means on said copying machine;

means for feeding each one of said plurality of copy paper sheets from said paper storing means to said copy process means;

means for detecting the number of copy paper sheets present in said paper storing means, said means for detecting the number of copy paper sheets present in said paper storing means including a plurality of light receiving elements in a vertical arrangement within said paper storing means and at least one light emitting element in an opposing relationship to said plurality of light receiving elements, the number of copy paper sheets present in said paper storing means being determined by counting the number of said light receiving elements which receive light;

means for designating the number of originals to be copied;

means for determining whether or not the number of copy paper sheets present in said paper storing means exceeds the total number of copies to be made for each original designated by said means for designating within a predetermined length of time after said paper storing means is set in the copying machine and prior to feeding the copy paper sheets to the paper process means; and means for warning an operator that the total number of originals to be copied is greater than the number of copy paper sheets present in said paper storing means.

2. The copy machine according to claim 1, wherein said means for detachably receiving includes a plurality of receiving ports for detachably receiving a plurality of paper storing means, and wherein said means for determining and said means for warning correspond to said plurality of means for detachably receiving said paper storing means.

3. The copying machine accoriding to claim 1, wherein said plurality of light receiving elements for detecting the number of copy paper sheets present in said paper storing means enable detection of a maximum number of copy paper sheets available for transfer to a reservation copying operation bin.

4. The copying machine according to claim 1, further including a plurality of detection circuits responsive to said plurality of light receiving elements, whereby output levels of each of said plurality of light receiving elements are compared with reference levels for each of said plurality of light receiving elements for determining if light is received by said light receiving element or not.

* * * * *